US009340847B2

(12) United States Patent
Altschuler et al.

(10) Patent No.: US 9,340,847 B2
(45) Date of Patent: May 17, 2016

(54) METHODS OF MANUFACTURING STEEL TUBES FOR DRILLING RODS WITH IMPROVED MECHANICAL PROPERTIES, AND RODS MADE BY THE SAME

(75) Inventors: Eduardo Altschuler, Buenos Aires (AR); Pablo Egger, Buenos Aires (AR)

(73) Assignee: Tenaris Connections Limited, Kingstown (VC)

( * ) Notice: Subject to any disclaimer, the term of this patent is extended or adjusted under 35 U.S.C. 154(b) by 849 days.

(21) Appl. No.: 13/443,669

(22) Filed: Apr. 10, 2012

(65) Prior Publication Data

US 2013/0264123 A1 Oct. 10, 2013

(51) Int. Cl.

*C21D 9/08* (2006.01)
*C21D 8/10* (2006.01)
(Continued)

(52) U.S. Cl.

CPC ..... *C21D 8/0236* (2013.01); *C21D 1/18* (2013.01); *C21D 1/30* (2013.01); *C21D 8/0268* (2013.01); *C21D 8/105* (2013.01); *C21D 9/08* (2013.01); *C21D 9/085* (2013.01); *C22C 38/001* (2013.01); *C22C 38/002* (2013.01); *C22C 38/008* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01); *C22C 38/60* (2013.01); *B21B 23/00* (2013.01); *C21D 2211/002* (2013.01); *C21D 2211/008* (2013.01)

(58) Field of Classification Search

CPC ..... C21D 8/105; C21D 9/08–9/085
USPC ..... 148/519, 547, 593
See application file for complete search history.

(56) References Cited

U.S. PATENT DOCUMENTS 3,413,166 A 11/1968 Zackay et al.
3,655,465 A 4/1972 Snape et al.
(Continued)

FOREIGN PATENT DOCUMENTS

AR 0050159 A1 10/2006
CN 1401809 3/2003
(Continued)

OTHER PUBLICATIONS

"Seamless Steel Tubes for Pressure Purposes—Technical Delivery Conditions—Part 1: Non-alloy Steel Tubes with Specified Room Temperature Properties" British Standard BS EN 10216-1:2002 E:1-26, published May 2002.
(Continued)

*Primary Examiner* — Brian Walck
(74) *Attorney, Agent, or Firm* — Knobbe Martens Olson and Bear LLP

(57) ABSTRACT

Embodiments of the present disclosure are directed to methods of manufacturing steel tubes that can be used for mining exploration, and rods made by the same. Embodiments of the methods include a quenching of steel tubes from an austenitic temperature prior to a cold drawing, thereby increasing mechanical properties within the steel tube, such as yield strength, impact toughness, hardness, and abrasion resistance. Embodiments of the methods reduce the manufacturing step of quenching and tempering ends of a steel tube to compensate for wall thinning during threading operations. Embodiments of the methods also tighten dimensional tolerances and reduce residual stresses within steel tubes.

26 Claims, 2 Drawing Sheets

(51) Int. Cl.

| | |
|---|---|
| ***C21D 8/02*** | (2006.01) |
| ***C21D 1/18*** | (2006.01) |
| ***C21D 1/30*** | (2006.01) |
| ***C22C 38/04*** | (2006.01) |
| ***C22C 38/00*** | (2006.01) |
| ***C22C 38/02*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/54*** | (2006.01) |
| ***C22C 38/60*** | (2006.01) |
| *B21B 23/00* | (2006.01) |

(56) References Cited

U.S. PATENT DOCUMENTS

| | | | |
|---|---|---|---|
| 3,810,793 | A | 5/1974 | Heller |
| 3,915,697 | A | 10/1975 | Giuliani et al. |
| 4,231,555 | A | 11/1980 | Saito |
| 4,336,081 | A | 6/1982 | Hijikata et al. |
| 4,354,882 | A | 10/1982 | Greer |
| 4,376,528 | A | 3/1983 | Ohshimatani et al. |
| 4,379,482 | A | 4/1983 | Suzuki et al. |
| 4,407,681 | A | 10/1983 | Ina et al. |
| 4,526,628 | A | 7/1985 | Ohno et al. |
| 4,564,392 | A | 1/1986 | Ohhashi et al. |
| 4,710,245 | A | 12/1987 | Roether |
| 4,721,536 | A | 1/1988 | Koch et al. |
| 4,812,182 | A | 3/1989 | Fang et al. |
| 4,814,141 | A | 3/1989 | Imai et al. |
| 5,352,406 | A | 10/1994 | Barteri et al. |
| 5,454,883 | A | 10/1995 | Yoshie et al. |
| 5,538,566 | A | 7/1996 | Gallagher |
| 5,592,988 | A | 1/1997 | Meroni et al. |
| 5,598,735 | A | 2/1997 | Saito et al. |
| 5,879,474 | A | 3/1999 | Bhadeshia et al. |
| 5,944,921 | A | 8/1999 | Cumino et al. |
| 5,993,570 | A | 11/1999 | Gray |
| 6,030,470 | A | 2/2000 | Hensger et al. |
| 6,188,037 | B1 | 2/2001 | Hamada et al. |
| 6,196,530 | B1 | 3/2001 | Muhr et al. |
| 6,217,676 | B1 | 4/2001 | Takabe et al. |
| 6,248,187 | B1 | 6/2001 | Asahi et al. |
| 6,267,828 | B1 | 7/2001 | Kushida et al. |
| 6,311,965 | B1 | 11/2001 | Muhr et al. |
| 6,331,216 | B1 | 12/2001 | Toyooka et al. |
| 6,384,388 | B1 | 5/2002 | Anderson et al. |
| 6,514,359 | B2 | 2/2003 | Kawano |
| 6,632,296 | B2 | 10/2003 | Yoshinaga et al. |
| 6,648,991 | B2 | 11/2003 | Turconi et al. |
| 6,669,285 | B1 | 12/2003 | Park et al. |
| 6,669,789 | B1 | 12/2003 | Edelman et al. |
| 6,682,610 | B1 | 1/2004 | Inoue |
| 6,683,834 | B2 | 1/2004 | Ohara et al. |
| 6,709,534 | B2 | 3/2004 | Kusinski et al. |
| 6,767,417 | B2 | 7/2004 | Fujita et al. |
| 6,958,099 | B2 | 10/2005 | Nakamura et al. |
| 7,074,283 | B2 | 7/2006 | Omura |
| 7,083,686 | B2 | 8/2006 | Itou |
| 7,118,637 | B2 | 10/2006 | Kusinski et al. |
| 7,214,278 | B2 | 5/2007 | Kusinski et al. |
| 7,264,684 | B2 | 9/2007 | Numata et al. |
| 7,635,406 | B2 | 12/2009 | Numata et al. |
| 7,744,708 | B2 | 6/2010 | López et al. |
| 7,862,667 | B2 | 1/2011 | Turconi et al. |
| 8,002,910 | B2 | 8/2011 | Tivelli et al. |
| 8,007,601 | B2 | 8/2011 | López et al. |
| 8,007,603 | B2 | 8/2011 | Garcia et al. |
| 8,016,362 | B2 | 9/2011 | Itoga |
| 8,317,946 | B2 | 11/2012 | Arai et al. |
| 8,414,715 | B2 | 4/2013 | Altschuler et al. |
| 8,636,856 | B2 | 1/2014 | Altschuler et al. |
| 8,821,653 | B2 | 9/2014 | Anelli et al. |
| 8,926,771 | B2 | 1/2015 | Agazzi |
| 2001/0035235 | A1 | 11/2001 | Kawano |
| 2002/0011284 | A1 | 1/2002 | Von Hagen et al. |
| 2003/0019549 | A1 | 1/2003 | Turconi et al. |
| 2003/0111146 | A1 | 6/2003 | Kusinski et al. |
| 2003/0116238 | A1 | 6/2003 | Fujita |
| 2003/0155052 | A1 | 8/2003 | Kondo et al. |
| 2003/0165098 | A1 | 9/2003 | Ohara et al. |
| 2004/0118490 | A1 | 6/2004 | Klueh et al. |
| 2004/0131876 | A1 | 7/2004 | Ohgami et al. |
| 2004/0139780 | A1 | 7/2004 | Cai et al. |
| 2005/0076975 | A1 | 4/2005 | Lopez et al. |
| 2005/0087269 | A1 | 4/2005 | Merwin |
| 2006/0124211 | A1 | 6/2006 | Takano et al. |
| 2006/0137781 | A1 | 6/2006 | Kusinski et al. |
| 2006/0169368 | A1 | 8/2006 | Lopez et al. |
| 2006/0231168 | A1* | 10/2006 | Nakamura et al. ..... 148/334 |
| 2006/0243355 | A1 | 11/2006 | Haiderer et al. |
| 2007/0089813 | A1 | 4/2007 | Tivelli |
| 2007/0137736 | A1 | 6/2007 | Omura et al. |
| 2007/0216126 | A1 | 9/2007 | Lopez et al. |
| 2008/0047635 | A1 | 2/2008 | Kondo et al. |
| 2008/0129044 | A1 | 6/2008 | Carcagno et al. |
| 2008/0219878 | A1 | 9/2008 | Kondo et al. |
| 2008/0226396 | A1 | 9/2008 | Garcia et al. |
| 2008/0314481 | A1 | 12/2008 | Garcia et al. |
| 2009/0010794 | A1 | 1/2009 | Turconi et al. |
| 2009/0047166 | A1 | 2/2009 | Tomomatsu et al. |
| 2009/0101242 | A1 | 4/2009 | Lopez et al. |
| 2010/0068549 | A1 | 3/2010 | Agazzi |
| 2010/0136363 | A1 | 6/2010 | Valdez et al. |
| 2010/0193085 | A1 | 8/2010 | Garcia |
| 2010/0294401 | A1 | 11/2010 | Gomez |
| 2010/0319814 | A1 | 12/2010 | Perez |
| 2010/0327550 | A1 | 12/2010 | Lopez |
| 2011/0097235 | A1 | 4/2011 | Turconi et al. |
| 2011/0247733 | A1 | 10/2011 | Arai et al. |
| 2012/0186686 | A1 | 7/2012 | Valdez |
| 2013/0199674 | A1 | 8/2013 | Altschuler |
| 2014/0057121 | A1 | 2/2014 | Altschuler |
| 2014/0272448 | A1 | 9/2014 | Valdez |

FOREIGN PATENT DOCUMENTS

| | | | |
|---|---|---|---|
| CN | 1487112 | | 4/2004 |
| CN | 101613829 | A | 12/2009 |
| CN | 101413089 | | 11/2010 |
| EP | 0 092 815 | | 11/1983 |
| EP | 0 658 632 | | 6/1995 |
| EP | 0 753 595 | | 1/1997 |
| EP | 0 828 007 | A | 3/1998 |
| EP | 0 989 196 | | 3/2000 |
| EP | 01027944 | B1 | 8/2000 |
| EP | 1 277 848 | | 1/2003 |
| EP | 1 288 316 | | 3/2003 |
| EP | 1 413 639 | | 4/2004 |
| EP | 1 717 324 | | 11/2006 |
| EP | 1 914 324 | | 4/2008 |
| EP | 2 028 284 | | 2/2009 |
| EP | 2 133 442 | | 12/2009 |
| JP | 60-086209 | | 5/1985 |
| JP | 60 174822 | | 9/1985 |
| JP | 60-215719 | | 10/1985 |
| JP | 36025719 | | 10/1985 |
| JP | 61270355 | | 11/1986 |
| JP | 63004046 | A2 | 1/1988 |
| JP | 63004047 | A2 | 1/1988 |
| JP | 63230847 | A2 | 9/1988 |
| JP | 63230851 | A2 | 9/1988 |
| JP | 01 259124 | A2 | 10/1989 |
| JP | 01 259125 | A2 | 10/1989 |
| JP | 01 283322 | A2 | 11/1989 |
| JP | 05-098350 | | 12/1990 |
| JP | 3006329 | A | 1/1991 |
| JP | 04 021718 | A2 | 1/1992 |
| JP | 04 107214 | | 4/1992 |

(56) References Cited

FOREIGN PATENT DOCUMENTS

| | | | |
|---|---|---|---|
| JP | 04 231414 | A2 | 8/1992 |
| JP | 05 287381 | A2 | 11/1993 |
| JP | 06-093339 | | 4/1994 |
| JP | 06 172859 | A2 | 6/1994 |
| JP | 06-220536 | | 8/1994 |
| JP | 07 041856 | A2 | 2/1995 |
| JP | 07 197125 | A2 | 8/1995 |
| JP | 08 311551 | | 11/1996 |
| JP | 09 067624 | A2 | 3/1997 |
| JP | 09-235617 | | 9/1997 |
| JP | 10 140250 | | 5/1998 |
| JP | 10176239 | | 6/1998 |
| JP | 10 280037 | A | 10/1998 |
| JP | 11 050148 | A | 2/1999 |
| JP | 11140580 | | 5/1999 |
| JP | 11229079 | | 8/1999 |
| JP | 2000-063940 | | 2/2000 |
| JP | 2000-178645 | | 6/2000 |
| JP | 2000-248337 | A | 9/2000 |
| JP | 2000-313919 | A2 | 11/2000 |
| JP | 2001-131698 | | 5/2001 |
| JP | 2001-164338 | | 6/2001 |
| JP | 2001-172739 | A2 | 6/2001 |
| JP | 2001-271134 | | 10/2001 |
| JP | 2002-096105 | A2 | 4/2002 |
| JP | 2004-011009 | | 1/2004 |
| KR | 0245031 | | 3/2000 |
| WO | WO 96/22396 | | 7/1996 |
| WO | WO 00/70107 | | 11/2000 |
| WO | WO 01/88210 | | 11/2001 |
| WO | WO 03/033856 | | 4/2003 |
| WO | WO 2004/031420 | | 4/2004 |
| WO | WO 2004/097059 | A1 | 11/2004 |
| WO | WO 2007/017161 | | 2/2007 |
| WO | WO 2008/003000 | | 1/2008 |
| WO | WO 2008/127084 | A2 | 10/2008 |
| WO | WO 2009/044297 | | 4/2009 |
| WO | WO 2010/061882 | | 6/2010 |

OTHER PUBLICATIONS

"Seamless Steel Tubes for Pressure Purposes—Technical Delivery Conditions—Part 2: Non-alloy and Alloy Steel Tubes with Specified Elevated Temperature Properties" British Standard BS EN 10216-2:2002+A2:2007:E:1-45, published Aug. 2007.

"Seamless Steel Tubes for Pressure Purposes—Technical Delivery Conditions—Part 3: Alloy Fine Grain Steel Tubes" British Standard BS EN 10216-3:2002 +A1:2004 E:1-34, published Mar. 2004.

"Seamless Steel Tubes for Pressure Purposes—Technical Delivery Conditions—Part 4: Non-alloy and Alloy Steel Tubes with Specified Low Temperature Properties" British Standard BS EN 10216-4:2002 +A1:2004 E:1-30, published Mar. 2004.

Aggarwal, R. K., et al.: "Qualification of Solutions for Improving Fatigue Life at SCR Touch Down Zone", Deep Offshore Technology Conference, Nov. 8-10, 2005, Vitoria, Espirito Santo, Brazil, in 12 pages.

Anelli, E., D. Colleluori, M. Pontremoli, G. Cumino, A. Izquierdo, H. Quintanilla, "Metallurgical design of advanced heavy wall seamless pipes for deep-water applications", 4th International Conference on Pipeline Technology, May 9-13, 2004, Ostend, Belgium.

Asahi, et al., Development of Ultra-high-strength Linepipe, X120, Nippon Steel Technical Report, Jul. 2004, Issue 90, pp. 82-87.

ASM Handbook, Mechanical Tubing and Cold Finishing, Metals Handbook Desk Edition, (2000), 5 pages.

Bai, M., D. Liu, Y. Lou, X. Mao, L. Li, X. Huo, "Effects of Ti addition on low carbon hot strips produced by CSP process", Journal of University of Science and Technology Beijing, 2006, vol. 13, N° 3, p. 230.

Beretta, Stefano et al., "Fatigue Assessment of Tubular Automotive Components in Presence of Inhomogeneities", Proceedings of IMECE2004, ASME International Mechanical Engineering Congress, Nov. 13-19, 2004, pp. 1-8.

Berner, Robert A., "Tetragonal Iron Sulfide", Science, Aug. 31, 1962, vol. 137, Issue 3531, pp. 669.

Berstein et al.,"The Role of Traps in the Microstructural Control of Hydrogen Embrittlement of Steels" Hydrogen Degradation of Ferrous Alloys, Ed. T. Oriani, J. Hirth, and M. Smialowski, Noyes Publications, 1988, pp. 641-685.

Boulegue, Jacques, "Equilibria in a sulfide rich water from Enghien-les-Bains, France", Geochimica et Cosmochimica Acta, Pergamom Press, 1977, vol. 41, pp. 1751-1758, Great Britain.

Bruzzoni et al., "Study of Hydrogen Permeation Through Passive Films on Iron Using Electrochemical Impedance Spectroscopy", PhD Thesis, 2003, Universidad Nacional del Comahue de Buenos Aires, Argentina.

Cancio et al., "Characterization of microalloy precipitates in the austenitic range of high strength low alloy steels", Steel Research, 2002, vol. 73, pp. 340-346.

Carboni, A., A. Pigani, G. Megahed, S. Paul, "Casting and rolling of API X 70 grades for artic application in a thin slab rolling plant", Stahl u Eisen, 2008, N° 1, p. 131-134.

Chang, L.C., "Microstructures and reaction kinetics of bainite transformation in Si-rich steels," XP0024874, Materials Science and Engineering, vol. 368, No. 1-2, Mar. 15, 2004, pp. 175-182, Abstract, Table 1.

Clark, A. Horrell, "Some Comments on the Composition and Stability Relations of Mackinawite", Neues Jahrbuch fur Mineralogie, 1966, vol. 5, pp. 300-304, London, England.

Craig, Bruce D., "Effect of Copper on the Protectiveness of Iron Sulfide Films", Corrosion, National Association of Corrosion Engineers, 1984, vol. 40, Issue 9, pp. 471-474.

D.O.T. 178.68 Spec. 39, pp. 831-840, Non reusable (non refillable) cylinders, Oct. 1, 2002.

De Medicis, Rinaldo, "Cubic FeS, A Metastable Iron Sulfide", Science, American Association for the Advancement of Science, Steenbock Memorial Library, Dec. 11, 1970, vol. 170, Issue 3963, pp. 723-728.

Echaniz, G., Morales, C., Perez, T., "Advances in Corrosion Control and Materials in Oil and Gas Production" Papers from Eurocorr 97 and Eurocorr 98, 13, P. S. Jackman and L.M. Smith, Published for the European Federation of Corrosion, No. 26, European Federation of Corrosion Publications, 1999.

Fang, Hong-Sheng, et al.: "The Developing Prospect of Air-cooled Baintitic Steels", International Journal of Issi, vol. 2, No. 2, Feb. 1, 2005, pp. 9-18.

Gojic, Mirko and Kosec, Ladislav, , "The Susceptibility to the Hydrogen Embrittlement of Low Alloy Cr and CrMo Steels", ISIJ International, 1997, vol. 37, Issue 4, pp. 412-418.

Heckmann, et al., Development of low carbon Nb-Ti-B microalloyed steels for high strength large diameter linepipe, Ironmaking and Steelmaking, 2005, vol. 32, Issue 4, pp. 337-341.

Howells, et al.: "Challenges for Ultra-Deep Water Riser Systems", IIR, London, Apr. 1997, 11 pages.

Hutchings et al., "Ratio of Specimen thickness to charging area for reliable hydrogen permeation measurement", British Corrosion. Journal, 1993, vol. 28, Issue 4, pp. 309-312.

Iino et al., "Aciers pour pipe-lines resistant au cloquage et au criquage dus a l'hydrogene", Revue de Metallurgie, 1979, vol. 76, Issue 8-9, pp. 591-609.

Ikeda et al., "Influence of Environmental Conditions and Metallurgical Factors on Hydrogen Induced Cracking of Line Pipe Steel", Corrosion/80, National Association of Corrosion Engineers, 1980, vol. 8, pp. 8/1-8/18, Houston, Texas.

Izquierdo, et al.: "Qualification of Weldable X65 Grade Riser Sections with Upset Ends to Improve Fatigue Performance of Deepwater Steel Catenary Risers", Proceedings of the Eighteenth International Offshore and Polar Engineering Conference, Vancouver, BC, Canada, Jul. 6-11, 2008, p. 71.

Johnston, P. W., G.Brooks, "Effect of Al2O3 and TiO2 Additions on the Lubrication Characteristics of Mould Fluxes", Molten Slags, Fluxes and Salts '97 Conference, 1997 pp. 845-850.

Keizer, Joel, "Statistical Thermodynamics of Nonequilibrium Processes", Spinger-Verlag, 1987.

(56) References Cited

OTHER PUBLICATIONS

Kishi, T., H.Takeucgi, M.Yamamiya, H.Tsuboi, T.Nakano, T.Ando, "Mold Powder Technology for Continuous Casting of Ti-Stabilized Stainless Steels", Nippon Steel Technical Report, No. 34, Jul. 1987, pp. 11-19.
Korolev, D. F., "The Role of Iron Sulfides in the Accumulation of Molybdenum in Sedimentary Rocks of the Reduced Zone", Geochemistry, 1958, vol. 4, pp. 452-463.
Lee, Sung Man and Lee, Jai Young, "The Effect of the Interface Character of TiC Particles on Hydrogen Trapping in Steel", Acta Metall., 1987, vol. 35, Issue 11, pp. 2695-2700.
Mishael, et al., "Practical Applications of Hydrogen Permeation Monitoring," Corrosion, Mar. 28-Apr. 1, 2004, Corrosion 2004, Nacional Association of Corrosion Engineers, vol. Reprint No. 04476.
Morice et al., "Moessbauer Studies of Iron Sulphides", J. Inorg. Nucl. Chem., 1969, vol. 31, pp. 3797-3802.
Mukongo, T., P.C.Pistorius, and A.M.Garbers-Craig, "Viscosity Effect of Titanium Pickup by Mould Fluxes for Stainless Steel", Ironmaking and Steelmaking, 2004, vol. 31, No. 2, pp. 135-143.
Mullet et al., "Surface Chemistry and Structural Properties of Mackinawite Prepared by Reaction of Sulfide Ions with Metallic Iron", Geochemica et Cosmochemica Acta, 2002, vol. 66, Issue 5, pp. 829-836.
Murcowchick, James B. and Barnes, H.L., "Formation of a cubic FeS", American Mineralogist, 1986, vol. 71, pp. 1243-1246.
Nagata, M., J. Speer, D. Matlock, "Titanium nitride precipitation behavior in thin slab cast high strength low alloyed steels", Metallurgical and Materials Transactions A, 2002 ,vol. 33A, p. 3099-3110.
Nakai et al., "Development of Steels Resistant to Hydrogen Induced Cracking in Wet Hydrogen Sulfide Environment", Transactions of the ISIJ, 1979, vol. 19, pp. 401-410.
Pressure Equipment Directive 97/23/EC, May 29, 1997, downloaded from website:http://ec.europa.eu/enterprise/pressure_equipment/ped/index_en.html on Aug. 4, 2010.
Prevéy, Paul, et al., "Introduction of Residual Stresses to Enhance Fatigue Performance in the Initial Design", Proceedings of Turbo Expo 2004, Jun. 14-17, 2004, pp. 1-9.
Rickard, D.T., "The Chemistry of Iron Sulphide Formation at Low Tempuratures", Stockholm Contrib. Geol., 1969, vol. 26, pp. 67-95.
Riecke, Ernst and Bohnenkamp, Konrad, "Uber den Einfluss von Gittersoerstellen in Eisen auf die Wassersroffdiffusion", Z. Metallkde . . . , 1984, vol. 75, pp. 76-81.
Shanabarger, M.R. and Moorhead, R. Dale, "H2O Adsorption onto clean oxygen covered iron films", Surface Science, 1996, vol. 365, pp. 614-624.
Shoesmith, et al., "Formation of Ferrous Monosulfide Polymorphs During Corrosion of Iron by Aqueous Hydrogen Sulfide at 21 degrees C", Journal of the Electrochemical Society, 1980, vol. 127, Issue 5, pp. 1007-1015.
Skoczylas, G., A.Dasgupta, R.Bommaraju, "Characterization of the chemical interactions during casting of High-titanium low carbon enameling steels", 1991 Steelmaking Conference Proceeding, pp. 707-717.
Smyth, D., et al.: Steel Tublar Products, Properties and Selection: Irons, Steels, and High-Performance Alloys, vol. 1, ASM Handbook, ASM International, 1990, p. 327-336.
Spry, Alan, "Metamorphic Textures", Perganom Press, 1969, New York.
Taira et al., "HIC and SSC Resistance of Line Pipes for Sour Gas Service", Nippon Kokan Technical Report, 1981, vol. 31, Issue 1-13.
Taira et al., "Study on the Evaluation of Environmental Condition of Wet Sour Gas", Corrosion 83 (Reprint. No. 156, National Association of Corrosion Engineers), 1983, pp. 156/2-156/13, Houston, Texas.
Takeno et al., "Metastable Cubic Iron Sulfide—With Special Reference to Mackinawite", American Mineralogist, 1970, vol. 55, pp. 1639-1649.
Tenaris Newsletter for Pipeline Services, Apr. 2005, p. 1-8.
Tenaris Newsletter for Pipeline Services, May 2003, p. 1-8.
Thethi, et al.: "Alternative Construction for High Pressure High Temperature Steel Catenary Risers", OPT USA, Sep. 2003, p. 1-13.
Thewlis, G., Weldability of X100 linepipe, Science and Technology of Welding and Joining, 2000, vol. 5, Issue 6, pp. 365-377.
Tivelli, M., G. Cumino, A. Izquierdo, E. Anelli, A. Di Schino, "Metallurgical Aspects of Heavy Wall—High Strength Seamless Pipes for Deep Water Applications", RioPipeline 2005, Oct. 17-19, 2005, Rio (Brasil), Paper n° IBP 1008_05.
Todoroki, T. Ishii, K. Mizuno, A. Hongo, "Effect of crystallization behavior of mold flux on slab surface quality of a Ti-bearing Fe—Cr—Ni super alloy cast by means of continuous casting process", Materials Science and Engineering A, 2005, vol. 413-414, p. 121-128.
Turconi, G. L.: "Improvement of resistance to SSC initiation and propagation of high strength OCTG through microstruture and precipitation control"; "Paper 01077", NACE International, Houston, TX, Mar. 16, 2001. (XP009141583).
Vaughan, D. J. and Ridout, M.S., "Moessbauer Studies of Some Sulphide Minerals", J. Inorg Nucl. Chem., 1971, vol. 33, pp. 741-746.
Wegst, C.W., "Stahlüssel", Auflage 1989, Seite 119, 2 pages.
Drill Rod Joint Depth Capacity Chart, downloaded Jan. 15, 2013; http://www.boartlongyear.com/drill-rod-joint-depth-capacity-chart.
Mehling, Wilfred L.: "Hot Upset Forging," ASM Handbook vol. 14, 1998, pp. 84-95.

* cited by examiner

METHODS OF MANUFACTURING STEEL TUBES FOR DRILLING RODS WITH IMPROVED MECHANICAL PROPERTIES, AND RODS MADE BY THE SAME

BACKGROUND

1. Field

Embodiments of the present disclosure relate to manufacturing steel tubes and, in certain embodiments, relate to methods of producing steel tubes for wireline core drilling systems for geological and mining exploration.

2. Description of the Related Art

Steel tubes are used in drill rods for mining exploration. In particular, steel tubes can be used in wireline core drilling systems. The aim of core drilling is to retrieve a core sample, i.e. a long cylinder of rock, which geologists can analyze to determine the composition of the rock under the ground. A wireline core drilling system includes a string of steel tubes (also called rods or pipes) that are joined together (e.g., by threads). The string includes a core barrel at the foot end of the string in a hole. The core barrel includes, at its bottom, a cutting diamond bit. The core barrel also includes an inner tube and an outer tube. When the drilling string rotates, the bit cuts the rock, allowing the core to enter into the inner tube of the core barrel. The core sample is removed from the bottom of the hole through an overshot that is lowered on the end of a wireline. The overshot attaches to the top of the core barrel inner tube and the wireline is pulled back, disengaging the inner tube from the barrel. The inner tube is then hoisted to the surface within the string of drill rods. After the core is removed, the inner tube is dropped down into the outer core barrel and drilling resumes. Therefore, the wireline system does not require the removal of the rod strings for hoisting the core barrel to the surface, as in conventional core drilling, allowing great saving in time.

In particular, seamless or welded steel tubes can be used in drill rods and core barrels. Steel rods can be cast, pierced, and rolled or rolled, formed, and welded to form steel tubes. The steel tubes can go through a number of other processes and heat treatments to form a final product. The standard manufacturing process of this product includes a quenching and tempering at both ends of each tube prior to threading to increase mechanical properties at the ends, as the connection between tubes is integral for mining exploration. Quenching and tempering at the ends of the rods has been utilized as the wall thickness of the tubes may be reduced by almost 50% of the original thickness upon threading of the tube. Therefore, in order to compensate for the loss of material in the tube, the mechanical properties at the ends are increased by the quenching and tempering. Elimination of this process, only at both ends of the bar, would simplify producing a final product.

Steel tubes used as wireline drill rods (WLDR) desire tight dimensional tolerances, i.e. outer diameter and inner diameter consistency, concentricity, and straightness. The reason for these tight dimensional tolerances is two-fold. On one hand, the finished rods, upon manufacturing, have flush connections which are integral for operation. No coupling is used. If the tube geometry does not have the appropriate dimensions, the threading procedure can create tube vibration. Additionally, the threads can be incompletely formed and the tubes can lack the remnant tube wall thickness at the threading. On the other hand, during field operation the WLDR is rotated at a very high speed, up to about 1700 rpm, requiring appropriate concentricity to avoid vibrations in the rod column. Also, a tight dimensional tolerance for the inner diameter is desired to hoist the core barrel in a smooth and uninterrupted way. For these reasons, cold drawn tubes have been used for high performance WLDR. If the tubes are full length quenched and tempered after cold drawing, in order to improve the mechanical properties, dimensional tolerances in the outer and inner diameter are negatively impaired. Therefore, the standard tubes used in the market are cold drawn stress relieved (SR) tubes. The stress relieving heat treatment is performed on the tubes to lower the tube residual stresses. However, the microstructure resulting from a hot rolled and then cold drawn SR tube is substantially ferrite-pearlite with a relatively poor impact toughness. Due to the ferrite-pearlite microstructure formed, WLDR manufacturers are currently forced to quench and temper both tube ends at the location where the threads are going to be machined in order to improve the mechanical properties in these critical zones. End quenching and tempering is a critical, yet expensive, operation. Also, the tube body remains with the original ferrite-pearlite microstructure with poor impact toughness. Field failures occur due to the ferrite-pearlite microstructure within the tube body. In some cases, indentations produced by machine gripping propagate a long crack that has not arrested, therefore producing a high severity failure mode. On top of that, there is a strong limitation in the mechanical strength that can be achieved through cold drawing. Therefore, the abrasion resistance of WLDR at the tube body is relatively poor, and many rods have to be scrapped before the expected rod life.

The conditions for operating mining exploration are very demanding. Steel tubes used in mining exploration are affected by, at least, torsion forces, tension forces, and bending forces. Due to the demanding stresses imposed on the steel tubes, preferred standard properties for drill rods are a yield strength of at least about 620 MPa, an ultimate tensile strength of at least about 724 MPa, and an elongation of at least 15%. For rods currently on the market, the main deficiencies are low toughness, relatively low hardness, and weak mechanical properties.

High abrasion resistance is therefore desirable for steel tubes for drill rods as well as good mechanical properties such as high impact toughness while maintaining good dimensional tolerances. As such, there is a need to improve these properties over conventional steel tubes.

SUMMARY

Embodiments of the present disclosure are directed to steel tubes or pipes and methods of manufacturing the same.

In some embodiments, a method of manufacturing a steel tube comprises casting a steel having a certain composition into a bar or slab. The composition comprises about 0.18 to about 0.32 wt. % carbon, about 0.3 to about 1.6 wt. % manganese, about 0.1 to about 0.6 wt. % silicon, about 0.005 to about 0.08 wt. % aluminum, about 0.2 to about 1.5 wt. % chromium, about 0.2 to about 1.0 wt. % molybdenum, and the balance comprises iron and impurities. The amount of each element is provided based upon the total weight of the steel composition. A tube can then be formed from the composition, wherein the tube can be quenched from an austenitic temperature to form a quenched tubed. In some embodiments, the austenitic temperature is at least about 50° C. above AC3 temperature and less than about 150° C. above AC3 temperature. In some embodiments, the quenching is performed from an austenitic temperature at a rate of at least about 20° C./sec. The tube can then be cold drawn and tempered to form a steel tube. In some embodiments, the cold drawing results in about a 6% area reduction of the tube.

In some embodiments, the quenched tube can be tempered before cold drawing. In some embodiments, the quenched tube can be straightened before cold drawing. The tube can also be straightened before the final tempering.

In some embodiments, the tube is formed by piercing and hot rolling a bar. In other embodiments, the tube is formed by welding a slab into an electron resistance welding (ERW) tube. In some embodiments, the tube can be cold drawn before quenching from an austenitic temperature. The cold drawing can reduce the cross-sectional area of the tube by at least 15%.

In some embodiments, the microstructure of the steel tube is at least about 90% tempered martensite. In some embodiments, the steel tube has at least one threaded end that has not been heat treated differently from other portions of the steel tube.

In some embodiments, the steel composition further comprises about 0.2 to about 0.3 wt. % carbon, about 0.3 to about 0.8 wt. % manganese, about 0.8 to about 1.2 wt. % chromium, about 0.01 to about 0.04 wt. % niobium, about 0.004 to about 0.03 wt. % titanium, about 0.0004 to about 0.003 wt. % boron, and the balance comprises iron and impurities. The amount of each element is provided based upon the total weight of the steel composition.

In some embodiments, a steel tube can be manufactured according to the methods described above. In some embodiments, a drill rod comprising a steel tube can be manufactured. In some embodiments, the steel tubes can be used for drill mining.

In some embodiments, a method of manufacturing a steel tube for the use as a drilling rod for wireline system comprises casting a steel having a certain composition into a bar or slab. The composition comprises about 0.2 to about 0.3 wt. % carbon, about 0.3 to about 0.8 wt. % manganese, about 0.1 to about 0.6 wt. % silicon, about 0.8 to about 1.2 wt. % chromium, about 0.25 to about 0.95 wt. % molybdenum, about 0.01 to about 0.04 wt. % niobium, about 0.004 to about 0.03 wt. % titanium, about 0.005 to about 0.080 wt. % aluminum, about 0.0004 to about 0.003 wt. % boron, up to about 0.006 wt. % sulfur, up to about 0.03 wt. % phosphorus, up to about 0.3 wt. % nickel, up to about 0.02 wt. % vanadium, up to about 0.02 wt. % nitrogen, up to about 0.008 wt. % calcium, up to about 0.3 wt. % copper, and the balance comprises iron and impurities. The amount of each element is provided based upon the total weight of the steel composition. In some embodiments, a tube can be formed out of the bar or slab, which can then be cooled to about room temperature. The tube can be cold drawn in a first cold drawing operation to effect an about 15% to about 30% area reduction and form a tube with an outer diameter between about 38 mm and about 144 mm and an inner diameter between about 25 mm and about 130 mm. The tube can then be heat treated to an austenizing temperature between about 50° C. above AC3 and less than about 150° C. above AC3, followed by quenching to about room temperature at a minimum of 20° C./second. The tube can then be cold drawn a second time to effect an area reduction of about 6% to about 14% to form a tube with an outer diameter of about 34 mm to about 140 mm and an inner diameter of about 25 mm to about 130 mm. A second heat treatment can be performed by heating the tube to a temperature of about 400° C. to about 600° C. for about 15 minutes to about one hour to provide stress relief to the tube. The tube can then be cooled to about room temperature at a rate of between about 0.2° C./second and about 0.7° C./second. After processing, the tube can have a microstructure of about 90% or more tempered martensite and an average grain size of about ASTM 7 or finer. The tube can also have the following properties: an ultimate tensile strength above about 965 MPa, elongation above about 13%, hardness between about 30 and about 40 HRC, an impact toughness above about 30 J in the longitudinal direction at room temperature based on a 10×3.3 mm sample, and residual stresses of less than about 150 MPa.

In some embodiments, the tube can be formed by piercing and hot rolling a bar into a seamless tube at a temperature between about 1000 and about 1300° C. In other embodiments, a slab can be welded into an ERW tube.

In some embodiments, the composition of the steel tube further comprises about 0.24 to about 0.27 wt. % carbon, about 0.5 to about 0.6 wt. % manganese, about 0.2 to about 0.3 wt. % silicon, about 0.95 to about 1.05 wt. % chromium, about 0.45 to about 0.50 wt. % molybdenum, about 0.02 to about 0.03 wt. % niobium, about 0.008 to about 0.015 wt. % titanium, about 0.010 to about 0.040 wt. % aluminum, about 0.0008 to about 0.0016 wt. % boron, up to about 0.003 wt. % sulfur, up to about 0.015 wt. % phosphorus, up to about 0.15 wt. % nickel, up to about 0.01 wt. % vanadium, up to about 0.01 wt. % nitrogen, up to about 0.004 wt. % calcium, up to about 0.15 wt. % copper and the balance comprises iron and impurities. The amount of each element is provided based upon the total weight of the steel composition.

In some embodiments, the composition of the steel consists essential of about 0.2 to about 0.3 wt. % carbon, about 0.3 to about 0.8 wt. % manganese, about 0.1 to about 0.6 wt. % silicon, about 0.8 to about 1.2 wt. % chromium, about 0.25 to about 0.95 wt. % molybdenum, about 0.01 to about 0.04 wt. % niobium, about 0.004 to about 0.03 wt. % titanium, about 0.005 to about 0.080 wt. % aluminum, about 0.0004 to about 0.003 wt. % boron, up to about 0.006 wt. % sulfur, up to about 0.03 wt. % phosphorus, up to about 0.3 wt. % nickel, up to about 0.02 wt. % vanadium, up to about 0.02 wt. % nitrogen, up to about 0.008 wt. % calcium, up to about 0.3 wt. % copper and the balance comprises iron and impurities. The amount of each element is provided based upon the total weight of the steel composition.

In some embodiments, threads are provided at the end of the final steel tube without any additional heat treatments following the second heat treatment. In some embodiments, the final steel tube with the threaded ends has a substantially uniform microstructure.

In some embodiments, the tube can be straightened after the first heat treatment operation and before the second cold drawing operation. In some embodiments, the tube can be straightened after the second cold drawing operation and before the second heat treatment operation.

In some embodiments, the first treatment operation further comprises tempering the quenched tube at a temperature of 400° C. to 700° C. for about 15 minutes to about 60 minutes and cooling the tube to about room temperature at a rate of about 0.2° C./second to about 0.7° C./second.

In some embodiments, a steel tube can be manufactured according to the methods described above. In some embodiments, a drill rod comprising a steel tube can be manufactured. In some embodiments, a drill rod comprising a steel tube can be manufactured. In some embodiments, the steel tubes can be used for drill mining.

In some embodiments, a wireline core drilling system used in mining and geological exploration can comprise a drill string comprising a plurality of steel tubes joined together. The steel tubes can be manufactured and have the same compositions according to the above described methods. The system can have a core barrel at the end of the drill string.

The core barrel can comprise an inner tube and an outer tube where the outer tube is connected to a cutting diamond bit.

DETAILED DESCRIPTION

Figure 1:
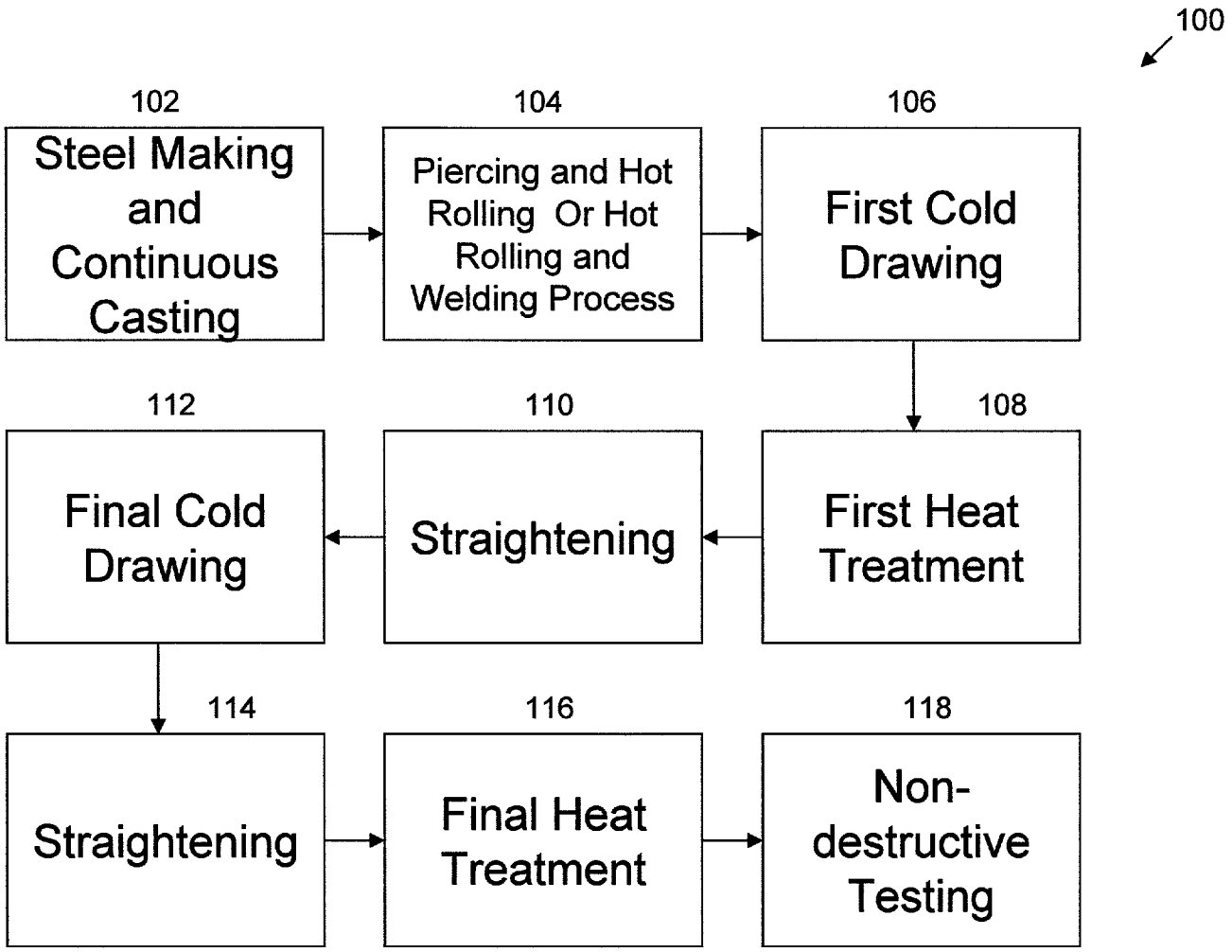
FIG. 1 is a flow diagram of an example method of manufacturing a steel tube compatible with certain embodiments described herein.

Embodiments of the present disclosure provide tubes (e.g., pipes, tubular rods and tubular bars) having a determinate steel composition, and methods of manufacturing them. In particular, the steel tubes can be seamless or welded tubes. The steel tubes may be employed, for example, as drill rods for mining exploration, such as diamond core drilling rods for wireline systems as discussed herein. However, the steel tubes described herein can be used in other applications as well.

The term "tube" as used herein is a broad term and includes its ordinary dictionary meaning and also refers to a generally hollow, straight, elongate member which may be formed to a predetermined shape, and any additional forming required to secure the formed tube in its intended location. The tube may have a substantially circular outer surface and inner surface, although other shapes and cross-sections are contemplated as well.

The terms "approximately", "about", and "substantially" as used herein represent an amount close to the stated amount that still performs a desired function or achieves a desired result. For example, the terms "approximately", "about", and "substantially" may refer to an amount that is within less than 10% of, within less than 5% of, within less than 1% of, within less than 0.1% of, and within less than 0.01% of the stated amount.

The term "room temperature" as used herein has its ordinary meaning as known to those skilled in the art and may include temperatures within the range of about 16° C. (60° F.) to about 32° C. (90° F.).

The term "up to about" as used herein has its ordinary meaning as known to those skilled in the art and may include 0 wt. %, minimum or trace wt. %, the given wt. %, and all wt. % in between.

In general, embodiments of the present disclosure comprise carbon steels and methods of manufacturing the same. As discussed in greater detail below, through a combination of steel composition and processing steps, a final microstructure may be achieved that gives rise to selected mechanical properties of interest, including one or more of minimum yield strength, tensile strength, impact toughness, hardness, and abrasion resistance. For example, the tube may be subject to a cold drawing process after being quenched from an austenitic temperature to form a steel tube with desired properties, microstructure, and dimensional tolerances.

The steel composition of certain embodiments of the present disclosure comprises a steel alloy comprising carbon (C) and other alloying elements such as manganese (Mn), silicon (Si), chromium (Cr), aluminum (Al) and molybdenum (Mo). Additionally, one or more of the following elements may be optionally present and/or added as well: vanadium (V), nickel (Ni), niobium (Nb), titanium (Ti), boron (B), nitrogen (N), Calcium (Ca), and Copper (Cu). The remainder of the composition comprises iron (Fe) and impurities. In certain embodiments, the concentration of impurities may be reduced to as low an amount as possible. Embodiments of impurities may include, but are not limited to, sulfur (S) and phosphorous (P). Residuals of lead (Pb), tin (Sn), antimony (Sb), arsenic (As), and bismuth (Bi) may be found in a combined maximum of 0.05 wt. %.

Elements within embodiments of the steel composition may be provided as below in Table I, where the concentrations are in wt. % unless otherwise noted. Embodiments of steel compositions may include a subset of elements of those listed in Table I. For example, one or more elements listed in Table I may not be required to be in the steel composition. Furthermore, some embodiments of steel compositions may consist of or consist essentially of the elements listed in Table I or may consist of or consist essentially of a subset of elements listed in Table I. For compositions provided throughout this specification, it will be appreciated that the compositions may have the exact values or ranges disclosed, or the compositions may be approximately, or about that of, the values or ranges provided.

TABLE I

Steel composition range (wt. %) after steelmaking operations.

| | Composition Range | | | | | |
|---|---|---|---|---|---|---|
| | General | | Particular | | Specific | |
| Element (wt. %) | Minimum | Maximum | Minimum | Maximum | Minimum | Maximum |
| C | 0.18 | 0.32 | 0.20 | 0.30 | 0.24 | 0.27 |
| Mn | 0.3 | 1.6 | 0.3 | 0.8 | 0.5 | 0.6 |
| S | — | 0.01 | — | 0.006 | — | 0.003 |
| P | — | 0.03 | — | 0.03 | — | 0.015 |
| Si | 0.1 | 0.6 | 0.1 | 0.6 | 0.2 | 0.3 |
| Ni | — | 1.0 | — | 0.3 | — | 0.15 |
| Cr | 0.2 | 1.5 | 0.8 | 1.2 | 0.95 | 1.05 |
| Mo | 0.2 | 1.0 | 0.25 | 0.95 | 0.45 | 0.50 |
| V | — | 0.1 | — | 0.02 | — | 0.01 |
| Nb | — | 0.08 | 0.01 | 0.04 | 0.02 | 0.03 |
| Ti | — | 0.1 | 0.004 | 0.03 | 0.008 | 0.015 |
| Al | 0.005 | 0.08 | 0.005 | 0.08 | 0.01 | 0.04 |
| B | — | 0.008 | 0.0004 | 0.003 | 0.0008 | 0.0016 |
| N | — | 0.02 | — | 0.02 | — | 0.01 |
| Ca | — | 0.008 | — | 0.008 | — | 0.004 |
| Cu | — | 0.3 | — | 0.30 | — | 0.15 |

C is an element whose addition inexpensively raises the strength of the steel. If the C content is less than about 0.18 wt. %, it may be in some embodiments difficult to obtain the strength desired in the steel. On the other hand, in some embodiments, if the steel composition has a C content greater than about 0.32 wt. %, toughness may be impaired. The general C content range is preferably about 0.18 to about 0.32 wt. %. A preferred range for the C content is about 0.20 to about 0.30 wt. %. A more preferred range for the C content is about 0.24 to about 0.27 wt. %.

Mn is an element whose addition is effective in increasing the hardenability of the steel, increasing the strength and toughness of the steel. If the Mn content is too low it may be difficult in some embodiments to obtain the desired strength in the steel. However, if the Mn content is too high, in some embodiments banding structures become marked and toughness decreases. Accordingly, the general Mn content range is about 0.3 to about 1.6 wt. %, preferably about 0.3 to about 0.8 wt. %, more preferably about 0.5 to about 0.6 wt. %.

S is an element that causes the toughness of the steel to decrease. Accordingly, the general S content of the steel in some embodiments is limited up to about 0.01 wt. %, preferably limited up to about 0.006 wt. %, more preferably limited up to about 0.003 wt. %.

P is an element that causes the toughness of the steel to decrease. Accordingly, the general P content of the steel in some embodiments is limited up to about 0.03 wt. %, preferably limited up to about 0.015 wt. %.

Si is an element whose addition has a deoxidizing effect during steel making process and also raises the strength of the steel. If the Si content is too low, the steel in some embodiments may be susceptible to oxidation, with a high level of micro-inclusions. On the other hand, though, if the Si content of the steel is too high, in some embodiments both toughness and formability of the steel decrease. Therefore, the general Si content range is about 0.1 to about 0.6 wt. %, preferably about 0.2 to about 0.3 wt. %.

Ni is an element whose addition increases the strength and toughness of the steel. However, Ni is very costly and, in certain embodiments, the Ni content of the steel composition is limited up to about 1.0 wt. %, preferably limited up to about 0.3 wt. %, more preferably limited up to about 0.15 wt. %.

Cr is an element whose addition increases hardenability and tempering resistance of the steel. Therefore, it is desirable for achieving high strength levels. In an embodiment, if the Cr content of the steel composition is less than about 0.2 wt. %, it may be difficult to obtain the desired strength. In other embodiments, if the Cr content of the steel composition exceeds about 1.5 wt. %, toughness may decrease. Therefore, in certain embodiments, the Cr content of the steel composition may vary within the range between about 0.2 to about 1.5 wt. %, preferably about 0.8 to about 1.2 wt. %, more preferably about 0.95 to about 1.05 wt. %.

Mo is an element whose addition is effective in increasing the strength of the steel and further assists in retarding softening during tempering. Mo additions may also reduce the segregation of phosphorous to grain boundaries, improving resistance to inter-granular fracture. In an embodiment, if the Mo content is less than about 0.2 wt. %, it may be difficult to obtain the desired strength in the steel. However, this ferroalloy is expensive, making it desirable to reduce the maximum Mo content within the steel composition. Therefore, in certain embodiments, Mo content within the steel composition may vary within the range between about 0.2 to about 1.0 wt. %, preferably about 0.25 to about 0.95 wt. %, more preferably about 0.45 to about 0.50 wt. %.

V is an element whose addition may be used to increase the strength of the steel by carbide precipitations during tempering. In some embodiments, if the V content of the steel composition is too great, a large volume fraction of vanadium carbide particles may be formed, with an attendant reduction in toughness of the steel. Therefore, in certain embodiments, the V content of the steel composition may be limited up to about 0.1 wt. %, preferably limited up to about 0.02 wt. %, more preferably limited up to about 0.01 wt. %.

Nb is an element whose addition to the steel composition may refine the austenitic grain size of the steel during hot rolling, with the subsequent increase in both strength and toughness. Nb may also precipitate during tempering, increasing the steel strength by particle dispersion hardening. In an embodiment, the Nb content of the steel composition may be limited up to about 0.08 wt. %, preferably about 0.01 to about 0.04 wt. %, more preferably about 0.02 to about 0.03 wt. %.

Ti is an element whose addition is effective in increasing the effectiveness of B in the steel. If the Ti content is too low it may be difficult in some embodiments to obtain the desired hardenability of the steel. However, in some embodiments, if the Ti content is too high, workability of the steel decreases. Accordingly, the general Ti content of the steel is limited up to about 0.1 wt. %, preferably about 0.004 to about 0.03 wt. %, more preferably about 0.008 to about 0.015 wt. %.

Al is an element whose addition to the steel composition has a deoxidizing effect during the steel making process and further refines the grain size of the steel. Therefore, the Al content of the steel composition may vary within the range between about 0.005 wt. % to about 0.08 wt. %, preferably about 0.01 wt. % to about 0.04 wt. %.

B is an element whose addition is effective in increasing the hardenability of the steel. If the B content is too low, it may be difficult in some embodiments to obtain the desired hardenability of the steel. However, in some embodiments, if the B content is too high, workability of the steel decreases. Accordingly, the general B content of the steel is limited up to about 0.008 wt. %, more preferably about 0.0004 to about 0.003 wt. %, even more preferably about 0.0008 to about 0.0016 wt. %.

N is an element that causes the toughness and workability of the steel to decrease. Accordingly, the general N content of the steel is limited up to about 0.02 wt. %, preferably limited up to about 0.010 wt. %.

Ca is an element whose addition to the steel composition may improve toughness by modifying the shape of sulfide inclusions. In some embodiments of the steel composition, excessive Ca is unnecessary and the steel composition may be limited up to 0.008 wt. %, preferably up to about 0.004 wt. %.

Cu is an element that is not required in certain embodiments of the steel composition. However, depending upon the steel fabrication process, the presence of Cu may be unavoidable. Thus, in certain embodiments, the Cu content of the steel composition may be limited up to about 0.30 wt. %, preferably up to about 0.15 wt. %.

Oxygen may be an impurity within the steel composition that is present primarily in the form of oxides. In an embodiment of the steel composition, as the oxygen content increases, impact properties of the steel are impaired. Accordingly, in certain embodiments of the steel composition, a relatively low oxygen content is desired, up to about 0.0050 wt. %, preferably up to about 0.0025 wt. %.

The contents of unavoidable impurities including, but not limited to, Pb, Sn, As, Sb, Bi and the like are preferably kept as low as possible. Furthermore, properties (e.g., strength, toughness) of steels formed from embodiments of the steel compositions of the present disclosure may not be substantially impaired provided these impurities are maintained below selected levels. In some embodiments, the Pb content of the steel composition may be up to about 0.005 wt. %. In other embodiments, the Sn content of the steel composition may be up to about 0.02 wt. %. In other embodiments, the As content of the steel composition may be up to about 0.012 wt. %. In other embodiments, the Sb content of the steel composition may be up to about 0.008 wt. %. In other embodiments, the Bi content of the steel composition may be up to about 0.003 wt. %. Preferably, the combined total of the purities is limited up to about 0.05 wt. %.

An embodiment of a method 100 of producing a steel tube is illustrated in FIG. 1. In operational block 102, a steel composition is provided and formed into a steel bar (e.g., rod) or slab (e.g., plate). The steel composition in one example is the steel composition discussed above in Table I. Melting of the steel composition can be done in an Electric Arc Furnace (EAF), with an Eccentric Bottom Tapping (EBT) system. Aluminum de-oxidation practice can be used to produce fine grain fully killed steel. Liquid steel refining can be performed by control of the slag and argon gas bubbling in the ladle furnace. Ca—Si wire injection treatment can be performed for residual non-metallic inclusion shape control. Bars (e.g., round bars) can be manufactured by continuous casting or continuous casting followed by rolling. The bars may, for example, have an outer diameter of about 150 mm to about 190 mm. After heating, the bars are cooled to about room temperature. Slabs (e.g., plates) can be manufactured by continuous casting.

In operational block 104, in some embodiments, the seamless tubes are manufactured by piercing and rolling solid steel bars. The rolling operations (e.g., hot rolling and stretch rolling) can be done under hot conditions by retained mandrel mill, floating mandrel mill, or plug mill processes. For example, the hot conditions may be a temperature of about 1000° C. to about 1300° C. After hot rolling and stretch rolling, the tube can be cooled to about room temperature at a rate of about 0.5 to about 2° C./second. For example, the tube can be air cooled, such as in still air. After rolling operations, the tubes may have an outer diameter of about 40 mm to about 150 mm, a wall thickness of about 4 mm to about 12 mm and an inner diameter of about 25 mm to about 130 mm.

In operational block 104, in some embodiments, welded tubes can be manufactured by hot rolling the cast steel slabs and then forming and welding the slabs into a round tube using an electron resistance welding (ERW) process. After ERW, the tubes may have an outer diameter of about 40 mm to about 150 mm, a wall thickness of about 4 mm to about 12 mm and an inner diameter of about 25 mm to about 130 mm.

In operational block 106, the tubes can be cold drawn after hot rolling or forming, such as cold drawn over a mandrel. Optionally, before cold drawing, the tube may go through an initial heat treatment at a temperature of about 800° C. to about 860° C., or to a temperature of about 50° C. to about 150° C. above AC3, followed by cooling to about room temperature at a rate of about 0.2 to about 0.6° C./sec. The cold drawing may result in an area reduction of about 15% to about 30%. The area reduction refers to the decrease in cross-sectional area perpendicular to the tube axis as a result of the drawing. Cold drawing can be performed at a temperature of about room temperature. After cold drawing, the tubes may have an outer diameter of about 38 mm to about 144 mm, a wall thickness of about 2.5 mm to about 10 mm and an inner diameter of about 25 mm to about 130 mm.

In operational block 108, after the first cold drawing step, the tubes can go through a first heat treatment. The first heat treatment includes heating the tube above austenitic temperature and quenching the tube to form a quenched tube. The heat treatment can be performed in automated lines, with the heat treatment cycle defined according to pipe diameter, wall thickness and steel grade. The tubes can be heated to austenitizing temperature at least about 50° C. above AC3 temperature and less than about 150° C. above AC3 temperature, preferably about 75° C. above AC3. The tube can then be quenched from the austenitizing temperature to less than about 80° C. at a minimum rate of about 20° C./second. Quenching can be performed either in a quenching tank by internal and external cooling or by means of quenching heads by external cooling. Water may be used to quench the tube. The first heat treatment may also include tempering. Tempering temperature and time can be defined in order to achieve the proposed mechanical properties for the final product. For example, tempering can be performed at about 400° C. to about 700° C. for a time of about 15 minutes to about 60 minutes. After tempering, the tube can be cooled to about room temperature at a rate of about 0.2° C./second to about 0.7° C./second such as by cooling in air, or inside a furnace cooling tunnel. This tempering can be substituted by the final heat treatment discussed below. In operational block 110, if it is necessary to straighten the tube, rotary straightening can be used.

In operational block 112, a final cold drawing can be performed to the tube after the first heat treatment to form the final tube. Tubes can be cold drawn after quenching, or after quenching and tempering, in order to reach the final dimensions with desired tolerances. For example, the tube can be cold drawn over mandrel. The final cold drawing can result in an area reduction of, at maximum, about 30%, preferably about 6% to about 14%. Cold drawing can be performed at a temperature of about room temperature. After the final cold drawing, the tubes may have an outer diameter of about 34 mm to about 140 mm, a wall thickness of about 2 mm to about 8 mm and an inner diameter of about 25 mm to about 130 mm. In operational block 114, further straightening of the tube can be performed, such as rotary straightening.

In operational block 116, a final heat treatment that includes a stress relieving/tempering is performed after the final cold drawing. Temperature can be defined in order to achieve the desired mechanical properties for the final product. For example, this heat treatment can be performed at about 400° C. to about 700° C. for a time of about 15 minutes to about 60 minutes. After heat treating, the tube can be cooled to about room temperature at a rate of about 0.2° C./second to about 0.7° C./second such as by cooling in air, or inside a furnace cooling tunnel. In some embodiments, no further cold drawing and/or rotary straightening is performed after the final heat treatment. In other embodiments, a final straightening after the final heat treatment may be performed; such as gag press straightening. In operational block 118, the tube can be tested with nondestructive testing (NDT) means, such as testing with ultrasonic or electromagnetic techniques.

The final microstructure of the steel tube may be mainly tempered martensite such as at least about 90% tempered martensite, preferably at least about 95% tempered martensite. The remainder of the microstructure is composed of bainite, and in some situations, traces of ferrite-pearlite. The average grain size of the microstructure is about ASTM 7 or finer. The complete decarburization is below about 0.25 mm, preferably below about 0.15 mm. Decarburization is defined and determined according ASTM E-1077. The type and size of inclusions can also be minimized. For example, Table II lists types and limits of inclusions for certain steel compositions described herein according to ASTM E-45. The ASTM E-1077 and ASTM E-45 standards in their entirety are hereby incorporated by reference.

TABLE II

| Micro inclusions (maximum rating) | | |
|---|---|---|
| Type of inclusion | Series | Severity |
| A oxides | Thin | ≤2.5 |
| | Heavy | ≤1.5 |
| B sulfides | Thin | ≤2.0 |
| | Heavy | ≤1.5 |
| C nitrides | Thin | ≤1.0 |
| | Heavy | ≤0.5 |
| D globular oxide type | Thin | ≤2.0 |
| | Heavy | ≤1.5 |

The microstructure in the steel tubes formed from embodiments of the steel compositions in this manner changes as the steel tubes are formed. During hot rolling, the microstructure is mainly ferrite and pearlite, with some bainite and austenite intermixed. Upon an initial heat treatment, before the first cold drawing, the microstructure is almost entirely ferrite and pearlite. This same microstructure is also found during the cold drawing of the steel tubes. After the steel tube has been heated and quenched, the microstructure within the tube is mainly martensite. The material is then tempered and forms a tempered martensite microstructure. The tempered martensite remains the dominant microstructure upon further cold drawing and the final heat treatment.

The steel tubes formed from embodiments of the steel compositions in this manner can possess a yield strength of at least about 135 ksi (about 930 MPa), an ultimate tensile strength of at least 140 ksi (about 965 MPa), an elongation of at least about 13%, and a hardness of about 30 to about 40 HRC. Furthermore, the material can have good impact toughness. For example, the material can have an impact toughness of at least about 30 J in a longitudinal direction at room temperature with a 10 mm×3.3 mm sample. Smaller sized specimens can be used for testing with impact toughness proportionally reduced with specimen area. Furthermore, the steel tube can have low residual stress compared to conventional cold drawn materials. For example, the residual stresses may be less than about 180 MPa, preferably less than about 150 MPa. The low residual stresses can be obtained with the stress relieving process after the final cold drawing and straightening. Also, using this process, tight dimensional tolerances can be achieved for a quenched and tempered cold drawn product. Significantly, tight dimensional tolerances can be achieved with a cold drawing process, unlike standard quench and tempered tubes without cold drawing which have a wider dimensional tolerance at about 20-40% over the preferred value. Furthermore, due to higher hardness, the tube may have improved abrasion resistance that improves performance of the material.

The process described herein can provide certain benefits. For example, this process can reduce the number of steps of the drill rod manufacturing process, compared to certain conventional processes. The quenching and tempering process at both ends of each rod can be eliminated prior to the threading process by producing a tube that has been full body quenched and tempered before the cold drawing, thus saving substantial resources for a purchaser of the rod. As a result, a full length uniform and homogeneous structure and mechanical properties is obtained with no transition zones. If only the ends are quenched and tempered, the ends present a martensite microstructure while the body of the tube presents a ferrite-pearlite microstructure. Therefore, the tube ends would present higher impact toughness than the body. The variation can be quantified by, for example, a hardness test or a microstructure analysis.

Furthermore, the process provides an improved method of manufacturing tubes to be used as drill rods for mining exploration. As a result of the process, a cold drawn tube with low residual stresses and tight dimensional tolerances can be obtained. Drill pipes made with this process, as a result of the hardness of the material, can have abrasion resistance and crack arresting capacity that improves the performance of the material. Drill rods made with this process will last longer, and if failure does occur, the failure mode will be of a much lower severity mode. Also, with elevated impact toughness, the behavior of the material is improved when compared with standard products for similar applications. As drill rods made with this process can be used in standard wireline systems, thinner and lighter rods can be manufactured for these applications. Standard rods have a YS of about 620 MPa minimum, an UTS of about 724 MPa minimum, and an elongation of about 15% minimum. Rods made with the process described herein can be improved to a YS of 930 MPa minimum, an UTS of 965 minimum, and an elongation of 13% minimum. The wall thickness can also be reduced by approximately 30-40% as well.

Figure 2:
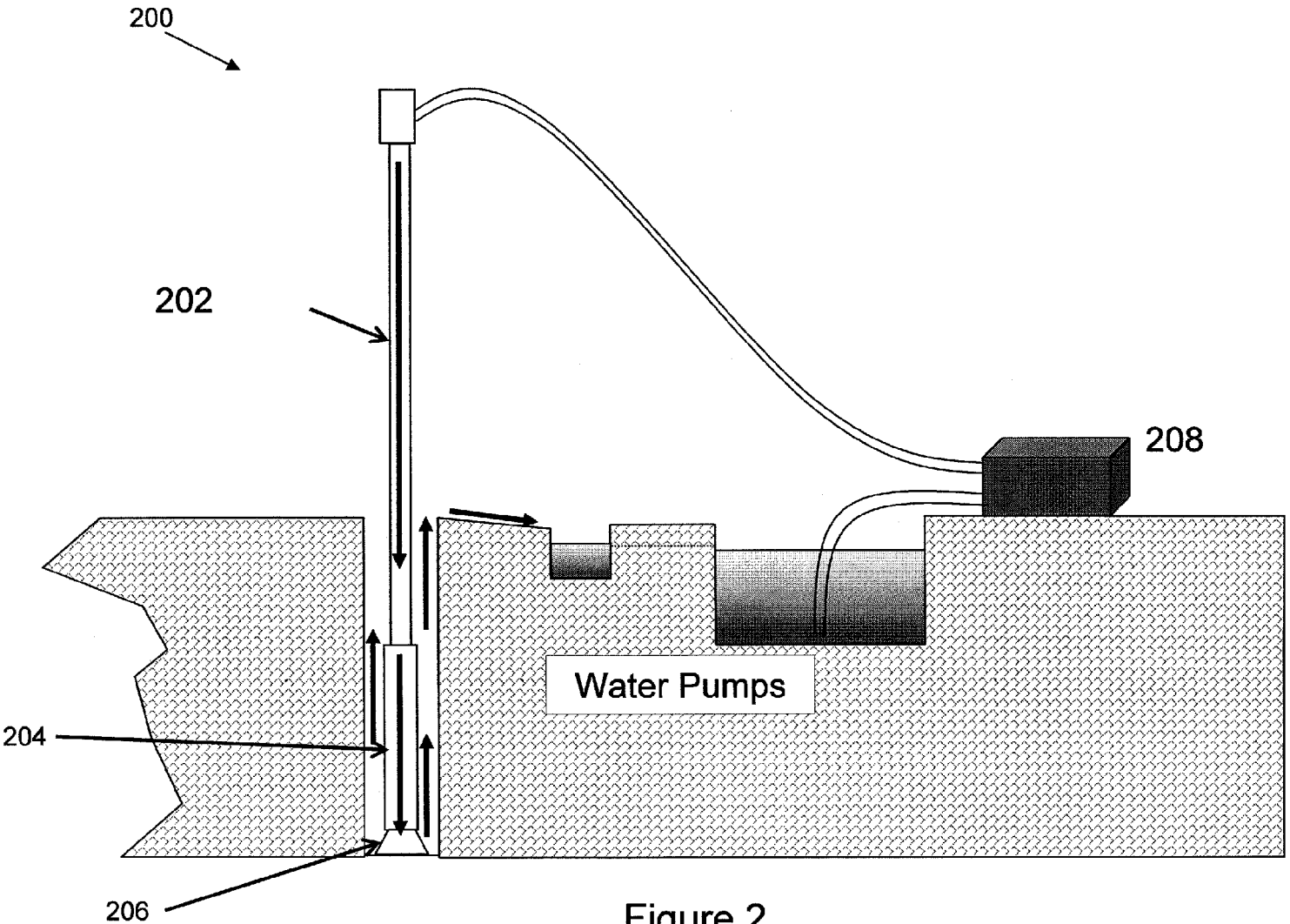
FIG. 2 illustrates a wireline core drilling system.

FIG. 2 illustrates an example of a wireline core drilling system which incorporates the steel tubes formed from embodiments of the steel compositions in the described manner. The steel tubes described herein can be used as drill rods (e.g., drill strings) in drilling systems such as wireline core drilling systems for mining exploration. A wireline core drilling system 200 includes a string of steel tubes 202 that are joined together (e.g., by threads). The string 202 can be, for example, between about 500 to about 3,500 meters in length to reach depths of those lengths. Each steel tube of the string 202 can be, for example, between about 1.5 meters to about 6 meters, more preferably about 3 meters. The string 202 includes a core barrel 204 at the end of the string in the hole. The core barrel 204 includes, at its bottom, a cutting diamond bit 206. The core barrel 204 also includes an inner tube and an outer tube. The outer tube may have an outer diameter of about 55 mm to about 139 mm, and the inner tube may have an outer diameter of about 45 mm to about 125 mm. When the drilling string 202 rotates (e.g., up to about 1700 revolutions per minute), the bit 206 cuts the rock, pushing core into the inner tube of the core barrel 204. As the drill digs deeper into the earth, a driller adds rods onto the upper end, lengthening the drill string 202. The core sample is removed from the bottom of the hole through an overshot that is lowered on the end of a wireline. The overshot attaches to the top of the core barrel inner tube and the wireline is pulled back disengaging the inner tube from the barrel 204. The inner tube is then hoisted to surface within the string of drill rods 202. A cooling system, such as a circulation pump 208, is used to cool the core drilling system 200 as it digs into the earth. After the core is removed, the inner tube is dropped down into the outer core barrel 204 and drilling resumes. Therefore, the wireline system 200 does not require the removal of the rod strings for hoisting the core barrel 204 to the surface, as in conventional core drilling, allowing great saving in time. The wireline system 200 can operate in either the vertical or the horizontal position. If the wireline system 200 is placed in a horizontal position, water pressure can be used to move the inner tube up into the core barrel 204. Tight dimensional control of the inner tube and barrel 204 is desired for the most efficient use of water pressure to move the inner tube into the core barrel 204.

EXAMPLES

The following examples are provided to demonstrate the benefits of the embodiments of methods of manufacturing steel tubes. These examples are discussed for illustrative purposes and should not be construed to limit the scope of the disclosed embodiments.

Three example compositions were manufactured using the processes described with respect to FIG. 1 above and the results are shown below. The chemistry design is shown in Table III and the ranges of mechanical properties are shown in Table IV-VI. Multiple tests were done on each example.

TABLE III

Chemical Composition of Test Trials

| Element | Example 1 | Example 2 | Example 3 |
|---|---|---|---|
| C | 0.25 | 0.25 | 0.26 |
| Mn | 0.55 | 0.55 | 0.54 |
| S | 0.002 | 0.002 | 0.001 |
| P | 0.011 | 0.011 | 0.008 |
| Si | 0.26 | 0.26 | 0.25 |
| Ni | 0.041 | 0.041 | 0.031 |

TABLE III-continued

| Chemical Composition of Test Trials | | | |
|---|---|---|---|
| Element | Example 1 | Example 2 | Example 3 |
| Cr | 1.01 | 1.01 | 1 |
| Mo | 0.27 | 0.27 | 0.47 |
| Cu | 0.049 | 0.049 | 0.07 |
| N | 0.0047 | 0.0047 | 0.0043 |
| Al | 0.031 | 0.031 | 0.029 |
| V | 0.005 | 0.005 | 0.006 |
| Nb | 0.031 | 0.031 | 0.023 |
| Ti | 0.011 | 0.011 | 0.012 |
| B | 0.0012 | 0.0012 | 0.0012 |
| Ca | 0.0014 | 0.0014 | 0.001 |
| Sn | 0.005 | 0.005 | 0.005 |
| As | 0.003 | 0.003 | 0.002 |

TABLE IV

| Physical Properties of Example 1 | | | | |
|---|---|---|---|---|
| Property | | | | |
| Yield Strength (MPa) | 1024 | 986 | 988 | 960 |
| Ultimate Tensile Strength (MPa) | 1062 | 1031 | 1035 | 1021 |
| Elongation (%) | 15.6 | 15.2 | 16 | 17.7 |
| Residual Stress (MPa) | 176 | 135 | 158 | 215 |
| Hardness (HRC) | 32 | 32 | 31 | 31 |
| Impact Toughness (J) | 32 | 33 | 31 | 32 |

TABLE V

| Physical Properties of Example 2 | | | | |
|---|---|---|---|---|
| Property | | | | |
| Yield Strength (MPa) | 1020 | 1035 | 1024 | 1029 |
| Ultimate Tensile Strength (MPa) | 1049 | 1059 | 1057 | 1055 |
| Elongation (%) | 16.1 | 16.6 | 16.4 | 16.7 |
| Residual Stress (MPa) | 118 | 135 | 129 | 127 |
| Hardness (HRC) | 35 | 35 | 35 | 35 |
| Impact Toughness (J) | 35 | 36 | 36 | 35 |

TABLE VI

| Physical Properties of Example 3 | | | | |
|---|---|---|---|---|
| Property | | | | |
| Yield Strength (MPa) | 1031 | 1033 | 1045 | 1038 |
| Ultimate Tensile Strength (MPa) | 1058 | 1066 | 1070 | 1064 |
| Elongation (%) | 16.6 | 17.1 | 17.3 | 16.9 |
| Residual Stress (MPa) | 72 | 83 | 54 | 63 |
| Hardness (HRC) | 35 | 36 | 36 | 36 |
| Impact Toughness (J) | 41 | 38 | 39 | 42 |

For the three examples, the samples were quenched and tempered, cold drawn, and subjected to stress relief treatment. Residual stress tests were performed according to the ASTM E-1928 standard. Hardness tests were performed according to the ASTM E-18 standard. Tension tests were performed according to the ASTM E-8 standard. Impact Toughness (Charpy) tests were performed according to ASTM E-23 standard using a 10×3.3 mm sample. The ASTM E-1928, ASTM E-18, ASTM E-8, and ASTM E-23 standards in their entirety are hereby incorporated by reference. Embodiments of the steel tubes described herein have a yield strength above about 930 MPa, an ultimate tensile strength of above about 965 MPa, an elongation above about 13%, a residual stress less than about 150 MPa, a hardness ranging between about 30 and 40 HRC, and an impact toughness of above 30 J (at about room temperature and with sample size 10×3.3).

Although the foregoing description has shown, described, and pointed out the fundamental novel features of the present teachings, it will be understood that various omissions, substitutions, and changes in the form of the detail of the apparatus as illustrated, as well as the uses thereof, may be made by those skilled in the art, without departing from the scope of the present teachings. Consequently, the scope of the present teachings should not be limited to the foregoing discussion, but should be defined by the appended claims.

What is claimed is:

1. A method of manufacturing a steel tube, comprising:

casting a steel having a composition into a bar or slab, the composition comprising:

about 0.18 to about 0.32 wt. % carbon;

about 0.3 to about 1.6 wt. % manganese;

about 0.1 to about 0.6 wt. % silicon;

about 0.005 to about 0.08 wt. % aluminum;

about 0.2 to about 1.5 wt. % chromium;

about 0.2 to about 1.0 wt. % molybdenum; and the balance comprises iron and impurities;

wherein the amount of each element is provided based upon the total weight of the steel composition;

forming a tube;

quenching the tube from an austenitic temperature to form a quenched tube;

cold drawing the quenched tube to form a final tube; and tempering the final tube to form the steel tube.

2. The method of claim 1, wherein the forming the tube comprises piercing and hot rolling the bar.

3. The method of claim 1, wherein the forming the tube comprises welding the slab into an ERW tube.

4. The method of claim 1, further comprising cold drawing the tube before quenching the tube from an austenitic temperature.

5. The method of claim 4, wherein cold drawing the tube before quenching the tube reduces a cross-sectional area of the tube by at least 15%.

6. The method of claim 1, further comprising tempering the quenched tube before cold drawing the quenched tube.

7. The method of claim 1, further comprising straightening the quenched tube before cold drawing the quenched tube.

8. The method of claim 1, further comprising straightening the final tube before tempering the final tube.

9. The method of claim 1, wherein a microstructure of the steel tube comprises at least about 90% tempered martensite.

10. The method of claim 1, wherein the steel tube comprises at least one threaded end that has not been heat treated differently from other portions of the steel tube.

11. The method of claim 1, wherein the cold drawing the quenched tube results in at least about a 6% area reduction of the quenched tube.

12. The method of claim 1, wherein the austenitic temperature is at least about 50° C. above AC3 temperature and less than about 150° C. above AC3 temperature.

13. The method of claim 1, wherein quenching the tube from an austenitic temperature is at a rate of at least about 20° C./sec.

14. The method of claim 1, wherein the composition further comprises:

about 0.2 to about 0.3 wt. % carbon;

about 0.3 to about 0.8 wt. % manganese;

about 0.8 to about 1.2 wt. % chromium;

about 0.01 to about 0.04 wt. % niobium;

about 0.004 to about 0.03 wt. % titanium;
about 0.0004 to about 0.003 wt. % boron; and
the balance comprises iron and impurities;
wherein the amount of each element is provided based upon the total weight of the steel composition.

15. A method of manufacturing a steel tube for use as a drilling rod for wireline systems, comprising:
casting a steel having a composition into a bar or slab, the composition comprising:
about 0.2 to about 0.3 wt. % carbon;
about 0.3 to about 0.8 wt. % manganese;
about 0.1 to about 0.6 wt. % silicon;
about 0.8 to about 1.2 wt. % chromium;
about 0.25 to about 0.95 wt. % molybdenum;
about 0.01 to about 0.04 wt. % niobium;
about 0.004 to about 0.03 wt. % titanium;
about 0.005 to about 0.080 wt. % aluminum;
about 0.0004 to about 0.003 wt. % boron;
up to about 0.006 wt. % sulfur;
up to about 0.03 wt. % phosphorus;
up to about 0.3 wt. % nickel;
up to about 0.02 wt. % vanadium;
up to about 0.02 wt. % nitrogen;
up to about 0.008 wt. % calcium;
up to about 0.3 wt. % copper; and
the balance comprises iron and impurities;
wherein the amount of each element is provided based upon the total weight of the steel composition;
forming a tube;
cooling the tube to about room temperature;
cold drawing the tube in a first cold drawing operation to effect an about 15% to about 30% area reduction and form a tube with an outer diameter between about 38 mm and about 144 mm and an inner diameter between about 25 mm and about 130 mm;
heat treating the tube according to a first heat treatment operation to an austenizing temperature between about 50° C. above AC3 and less than about 150° C. above AC3 following by quenching to about room temperature at a minimum of 20° C./second;
cold drawing the quenched tube in a second cold drawing operation to effect an area reduction of about 6% to about 14% to form a tube with an outer diameter of about 34 mm to about 140 mm and an inner diameter of about 25 mm to about 130 mm;
heat treating the tube in a second heat treatment operation to a temperature of about 400° C. to about 600° C. for about 15 minutes to about one hour to provide stress relief to the tube; and
cooling the tube after the second heat treatment operation to about room temperature at a rate of between about 0.2° C./second and about 0.7° C./second;
wherein the final steel tube after the second heat treatment operation has a microstructure of about 90% or more tempered martensite, an average grain size of about ASTM 7 or finer, a yield strength above about 930 MPa, an ultimate tensile strength above about 965 MPa, elongation above about 13%, hardness between about 30 and about 40 HRC, an impact toughness above about 30J in the longitudinal direction at room temperature based on a 10×3.3 mm sample, and residual stresses of less than about 150 MPa.

16. The method of claim 15, wherein the forming the tube comprises piercing and hot rolling the bar into a seamless tube at a temperature between about 1000 and about 1300° C.

17. The method of claim 15, wherein the forming the tube comprises welding the slab into an ERW tube.

18. The method of claim 15, wherein the composition comprises:
about 0.24 to about 0.27 wt. % carbon;
about 0.5 to about 0.6 wt. % manganese;
about 0.2 to about 0.3 wt. % silicon;
about 0.95 to about 1.05 wt. % chromium;
about 0.45 to about 0.50 wt. % molybdenum;
about 0.02 to about 0.03 wt. % niobium;
about 0.008 to about 0.015 wt. % titanium;
about 0.010 to about 0.040 wt. % aluminum;
about 0.0008 to about 0.0016 wt. % boron;
up to about 0.003 wt. % sulfur;
up to about 0.015 wt. % phosphorus;
up to about 0.15 wt. % nickel;
up to about 0.01 wt. % vanadium;
up to about 0.01 wt. % nitrogen;
up to about 0.004 wt. % calcium;
up to about 0.15 wt. % copper; and
the balance comprises iron and impurities;
wherein the amount of each element is provided based upon the total weight of the steel composition.

19. The method of claim 15, wherein the composition consists essentially of:
about 0.2 to about 0.3 wt. % carbon;
about 0.3 to about 0.8 wt. % manganese;
about 0.1 to about 0.6 wt. % silicon;
about 0.8 to about 1.2 wt. % chromium;
about 0.25 to about 0.95 wt. % molybdenum;
about 0.01 to about 0.04 wt. % niobium;
about 0.004 to about 0.03 wt. % titanium;
about 0.005 to about 0.080 wt. % aluminum;
about 0.0004 to about 0.003 wt. % boron;
up to about 0.006 wt. % sulfur;
up to about 0.03 wt. % phosphorus;
up to about 0.3 wt. % nickel;
up to about 0.02 wt. % vanadium;
up to about 0.02 wt. % nitrogen;
up to about 0.008 wt. % calcium;
up to about 0.3 wt. % copper; and
the balance comprises iron and impurities;
wherein the amount of each element is provided based upon the total weight of the steel composition.

20. The method of claim 15, further comprising providing threads on the end of the final steel tube without any additional heat treatments following the second heat treatment operation.

21. The method of claim 20, wherein the final steel tube with the threaded ends has a substantially uniform microstructure.

22. The method of claim 15, further comprising straightening the tube after the first heat treatment operation and before the second cold drawing operation.

23. The method of claim 15, further comprising straightening the tube after the second cold drawing operation and before the second heat treatment operation.

24. The method of claim 15, wherein the first heat treatment operation further comprises tempering the quenched tube at a temperature of 400° C. to 700° C. for about 15 minutes to about 60 minutes and cooling the tube to about room temperature at a rate of about 0.2° C./second to about 0.7° C./second.

25. A method of manufacturing a wireline system steel tube drilling rod having tight dimensional tolerances for outer diameter, inner diameter, concentricity, and straightness, the method comprising:
casting a steel having a composition into a bar or slab, the composition comprising:
about 0.18 to about 0.32 wt. % carbon;
about 0.3 to about 1.6 wt. % manganese;
about 0.1 to about 0.6 wt. % silicon;

about 0.005 to about 0.08 wt. % aluminum;
about 0.2 to about 1.5 wt. % chromium;
about 0.2 to about 1.0 wt. % molybdenum; and
the balance comprises iron and impurities;
wherein the amount of each element is provided based upon the total weight of the steel composition;
forming a tube;
quenching the tube from an austenitic temperature to form a quenched tube;
cold drawing the quenched tube to form a final tube with a maximum area reduction of about 30%;
tempering the final tube to form the steel tube; and
straightening the tempered tube.

26. The method of claim 25, wherein the cold drawing comprises forming a final tube with an area reduction of between about 6% to about 14%.

* * * * *